United States Patent [19]

Lambert, Jr.

[11] 4,373,717

[45] Feb. 15, 1983

[54] WRIST CURL MACHINE

[76] Inventor: Lloyd J. Lambert, Jr., 1538 College Ave., South Houston, Tex. 77587

[21] Appl. No.: 956,675

[22] Filed: Nov. 1, 1978

[51] Int. Cl.[3] ..... A63B 23/00

[52] U.S. Cl. ..... 272/67; 272/118; 172/143

[58] Field of Search ..... 272/67, 68, 118, 130, 272/132, 143, 144, DIG. 4, 117; 73/379; 128/25 R; 74/245 R, 245 C, 246

[56] References Cited

U.S. PATENT DOCUMENTS

| | | | |
|---|---|---|---|
| 3,495,824 | 2/1970 | Cuinier | 272/130 |
| 3,640,528 | 2/1972 | Proctor | 272/118 |
| 3,708,166 | 1/1973 | Annas | 272/118 X |
| 3,743,282 | 7/1973 | Zinkin | 272/118 |
| 3,752,473 | 8/1973 | Lalanne | 272/118 X |
| 3,850,431 | 11/1974 | Winans | 272/118 |
| 3,912,261 | 10/1975 | Lambert | 272/118 |
| 4,149,714 | 4/1979 | Lambert | 272/118 |

*Primary Examiner*—Richard C. Pinkham
*Assistant Examiner*—William R. Browne
*Attorney, Agent, or Firm*—Victor, Jr. Evans & Co.

[57] ABSTRACT

Disclosed herein is a wrist curl machine fabricated to isolate the wrist muscle and lower forearm muscle for development to the exclusion of all others and is defined by three hand grip areas, two sprockets associated with these three hand grip areas and chain elements operatively connected with these sprockets which in turn traverse through weights and a counter balance system whereby the counter balance system negates the weight of the elements associated with the structure and the variable weights themselves provide the total resistance to the work done by the wrist or the forearm of the exerciser. The framework is associated with and supports the hand grip, sprocket, chain, counter balance, and weight mechanism so that the machine can be used when the exerciser is erect.

8 Claims, 4 Drawing Figures

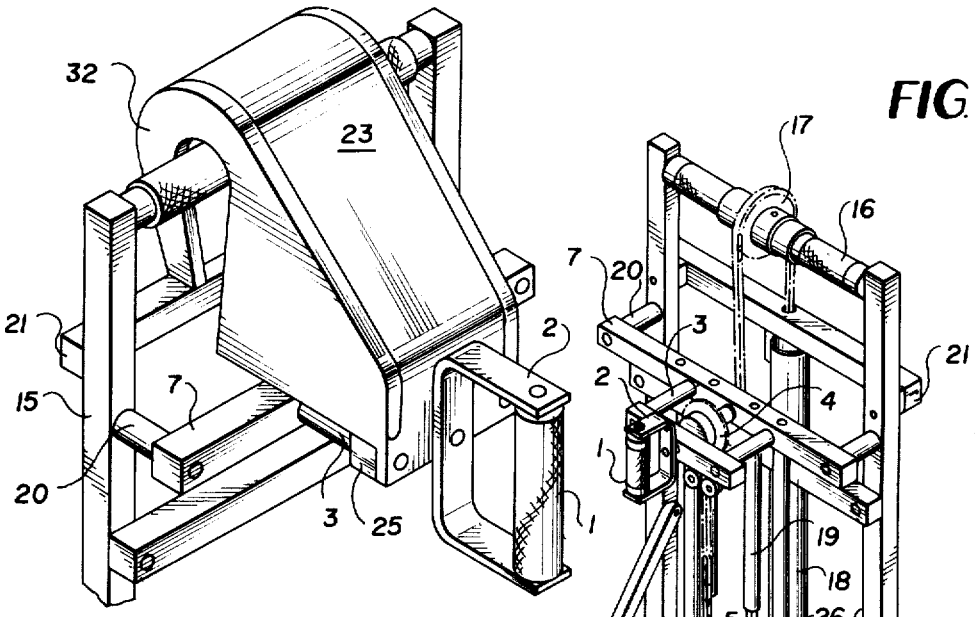
FIG. 3
FIG. 1
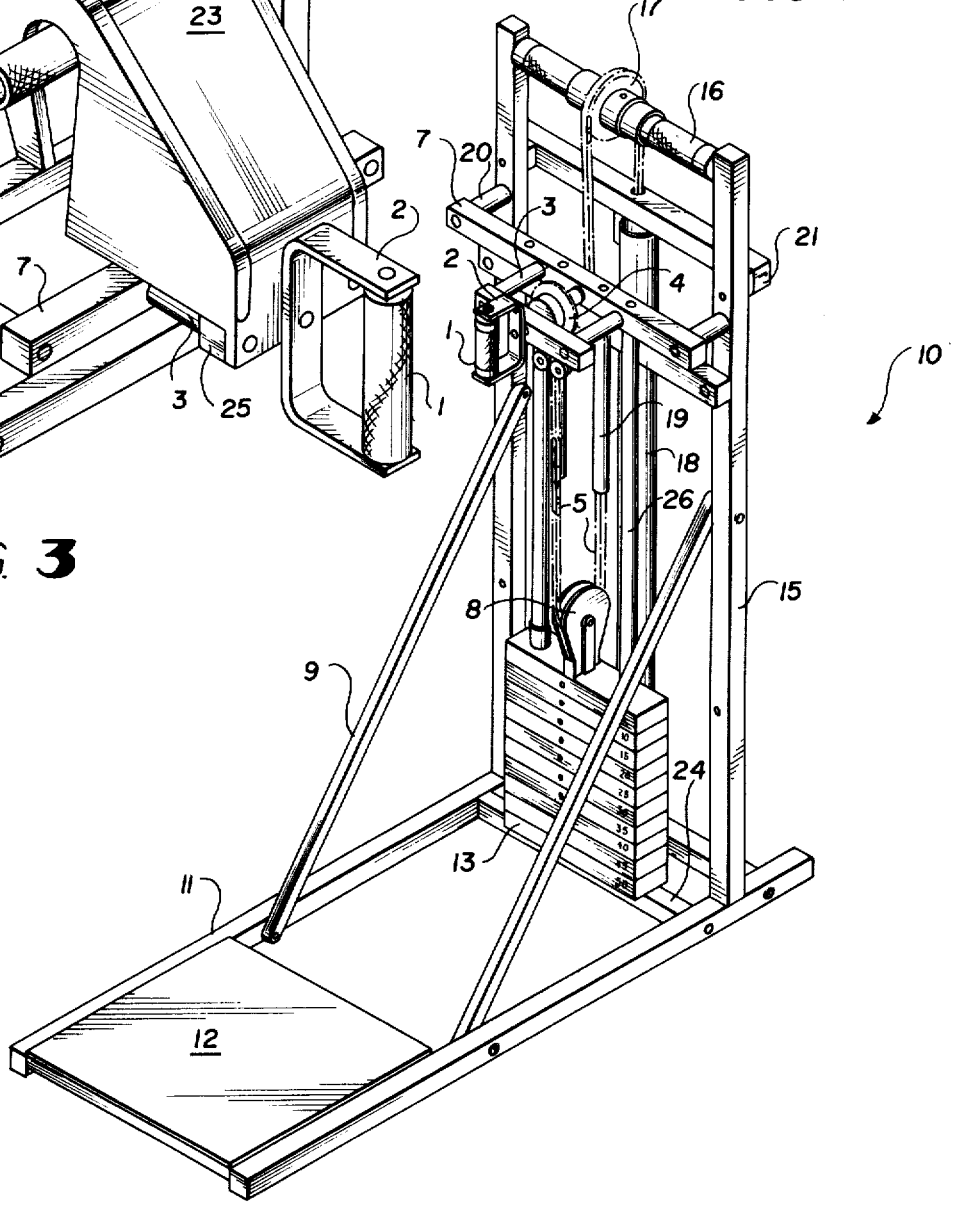

WRIST CURL MACHINE

BACKGROUND OF THE INVENTION

There are many areas of athletics and physical therapy in which it is desired to rehabilitate or increase the strength in specific areas to the exclusion of all others. It should be appreciated that in the prior art, wrist development and lower forearm development has been an area that has been neglected by most health equipment manufacturers when in fact, the wrist and forearm are vital not only in the performance of daily functions but particularily in sports such as tennis, bowling, and golf where wrist snapping provides a substantial increase in power. To this end, that is rehabilitation and improving strength of athletes and the like, this specific machine has been designed.

SUMMARY OF THE INVENTION

Accordingly, an object of this invention contemplates providing a mechanism in which the wrist and lower forearm can be exercised with the exclusion of all other muscles in the body.

A further object contemplates providing a single apparatus in which two exercises involving the wrist and lower forearm can be performed.

A further object contemplates an exercise machine which is durable in construction, safe to use, and provided with a plurality of variable weights so that as an exerciser's strength increases, the magnitude of the work can also increase.

Still yet another object of this invention contemplates providing a counter balance system associated with this exercise equipment whereby the effect of components other than the selected weights are negated thereby providing an accurate accounting of the amount of work being done.

These and other objects will be made manisfest when considering the following detailed specification and claims.

BRIEF DESCRIPTION OF THE DRAWINGS

FIG. 1 is an isometric view of the wrist curling machine according to the present invention;

FIG. 3 is a view of the top portion of the machine with a protective shroud disposed thereon.

DESCRIPTION OF THE PREFERRED EMBODIMENT

Figures 2, 4:
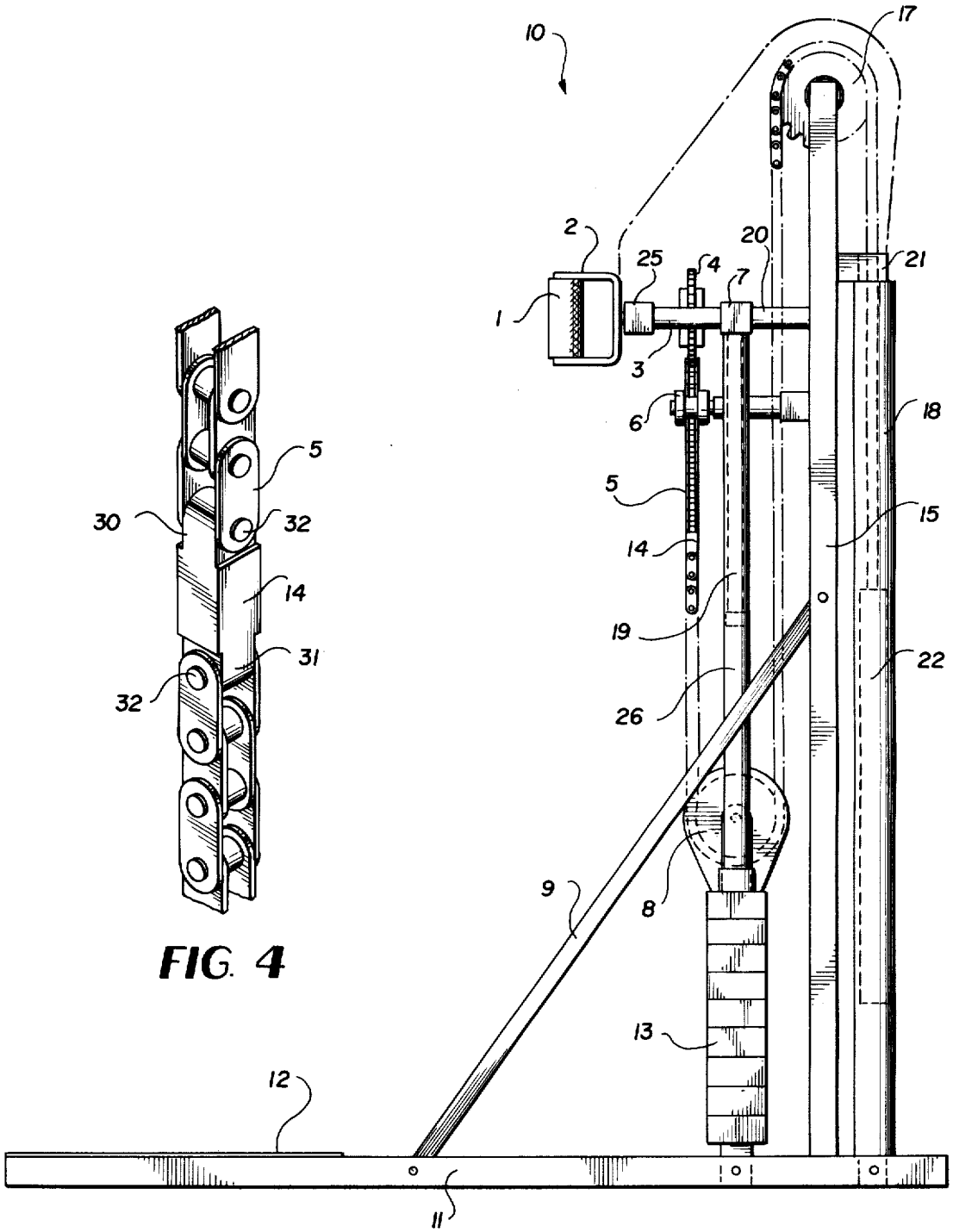
FIG. 2 is a side view thereof.
FIG. 4 is a view of the chain mechanism and a novel link element which changes the direction of the chain.

Referring to the drawings now wherein like reference numerals refer to like parts throughout the several drawings, reference numeral 10 is generally directed to the wrist curl machine according to the present invention.

This wrist curl machine 10 can generally be regarded as being provided with a rectangular frame defined by reference numerals 11 and 24 having a rubberized mat platform 12 disposed at the area where the exerciser will stand, and an upright frame network 15 and diagonally disposed support braces 9.

This framework provides the structure which supports the mechanism according to the present invention which will now be defined.

The top extremity of upright frame members 15 terminates in an axle having hand grips 16 disposed thereon. These hand grips are capable of rotation since they are supported on the upright frame members 15 through bearing elements which are preferably linear. Medially disposed between the hand grips 16 is a sprocket 17 having a chain disposed thereon. One end of the chain extends backwardly behind the machine as shown in FIG. 1 through a support cross bar 21 and terminates within a cylindrical sleeve 18 within which a counter balance weight 22 is provided at the terminal portion of the chain 5.

The chain extends over sprocket 17 and downwardly towards a second sprocket 8 which in appearance appears to be a pulley like shroud and the shroud extends downwardly into the plurality of weights 13 whose magnitude is adjustable. These weights 13 are capable of displacement only in a positive vertical direction upon initialization of the exercise, and they are constrained to ride upon rod members 26 as shown in the drawings. After traversing through sprocket 8, chain 5 extends upwardly and is provided with a twist of rectilinear orientation as shown in FIG. 4. The novel linking element 14 is defined by a rectangular block 14 which at opposed extremities thereof have U-shaped collars connected thereto but the orifices disposed within these U-shaped collars are opposed to each other by 90°. It will therefore be perceived that the chain links and their pin elements 32 when appropriately connected thereto will have been oriented by 90° as shown. This is important when following the ensuing course of chain 5 which continues upwardly to a further sprocket 4 which is in a different plane relative to either pulley 8 or sprocket 17.

The pulley 4 is connected to hand grip element 1 through a shaft element but it is to be appreciated that a hand grip 1 is inimately connected thereto as through hand guard framework 2 which is of U-shaped configuration. Therefore it will be perceived that rotation of hand grip 1 will cause similar rotation of sprocket 4 and will necessitate the upward displacement of the weights 13 as the chain winds on the sprocket 4.

The sprocket 4 and hand grip 1 are supported by a front framework denoted by reference numeral 20 which supports cross bar 7 outwardly away from the upright frame members 15 and thereafter cylindrical outwardly extending support bar 3 connected to crossbars 25 which provides the support for the handle 1 and sprocket 4. The sprocket 4 extends between the pair of spaced opposed parallel bars 3 and in between horizontal crossbars 7 and 25 through bearings so that rotation of the handle 1 will cause rotation of the sprocket 4 with miniminal amount of resistance and friction.

As best seen in FIG. 2, a pair of idler type sprockets 6 extend on both sides of the chain just below the sprocket 4 to serve as a guide. These guides are connected to the upright frame 15. Further disclosed, FIG. 1 especially, are downwardly extending stop members 19 which depend from cross bar 7 and serve as a stop element for the weights 13 so that their limit of vertical travel is limited. The length of these stop members 19 are determined so that the chain link element 14 will not come into contact with either the upper sprocket 4 or lower sprocket 8 since it will be appreciated that this link is not fashioned to roll thereover. The terminal portion of stop 19 is provided with a rubber tip so as to assure that the chrome plated weights will not be marred.

It will be appreciated therefore that two exercising devices can be driven off of a single set of weights and these two exercises will now be defined. The first exercise will be accomplished by twisting handle 1 and thereby wrapping chain onto sprocket 4 raising the weights 13. The second exercise is performed by having the hands wrap upon knurled hand grips 16 and twisting that shaft thereby causing sprocket 17 to rotate moving chain 15 and thereafter weights 13. The shaft and hand grip 16 can be rotated in two directions so that exercise can be performed on the wrist and lower forearm in two directions. In order to protect the exerciser and to assure that articles of clothing etc. will now become entrained in the sprockets, a shroud 23 is provided which covers sprocket 4 and 17 as shown in FIG. 3. Shroud 23 has side panels 32 in which the anterior portion is provided with a U-shaped recess so that it stradles hand grips 16 and has a closed face along the forward side portion thereof to isolate the exerciser from the front sprocket 4.

Having thus described the invention it will be apparent that there has been provided a wrist curl machine that provides exercise for the wrists and lower forearm and to the exclusion of all other muscles. It will be further appreciated that numerous structural modifications are contemplated as being a part of this invention as specified hereinabove and as defined hereinbelow in the claims.

What is claimed is:

1. A wrist curl machine comprising a shaft, a plurality of adjustable weights, a first hand grip means for being grasped by a user and for raising and lowering said plurality of adjustable weights, said first hand grip means being supported on said shaft, an upper first sprocket supported on said shaft so that rotation of said first hand grip means causes rotation of said upper first sprocket, a lower second sprocket, a chain connected to said upper first sprocket and which extends downwardly and around said lower second sprocket, said weights connected to said lower second sprocket, whereby when said hand grip means is rotated to wind the chain on said upper first sprocket, said weights will be displaced upwardly, said weights are constrained by vertical rods so that they are capable of only vertical displacement, said chain extends beyond said lower second sprocket upwardly to a third sprocket, an axle supporting said third sprocket, second hand grip means disposed on said axle on opposed sides of said third sprocket, whereby rotation of said second hand grips means on opposed sides of said third sprocket causes vertical displacement of said weights as well.

2. The device of claim 3 wherein said chain has a terminal extremity remote from said first hand grip means and wherein said terminal portion of said chain is connected to a counter balance weight which tends to negate all of the elements in said exercise machine except for the variable weights.

3. The device of claim 2 in which said first upper sprocket and it's axis is at right angles relative to said second lower and third sprockets and said chain is provided with means to change the orientation of said chain 90°.

4. The device of claim 3 in which said means to change the orientation comprises a link defined by a block element having U-shaped terminal portions orthogonally disposed relative to each other and each U-shaped portion surrounds a pin in said chain so that said chain above said element is 90° offset relative to the lower portion of the chain.

5. The device of claim 4 wherein a stop member is provided to limit the amount of vertical displacement of said weights.

6. The device of claim 5 in which a shroud is provided to cover said first and said third sprockets.

7. The device of claim 6 in which said shroud is defined by a top curved surface and side panels in which an anterior portion of said side panels is provided with a U-shaped cutout to overlie said second hand grip means which are disposed on opposed sides of said third sprocket and the side panels extend forwardly in a continuous fashion to cover completely said first upper sprocket.

8. The device of claim 7 in which said exercise machine is defined by a framework comprised of a rectangular base having reinforcing bars at one end, and a platform at another end, upright frame members which support said first upper and third sprockets, and diagonal support braces extending from said rectangular base to said upright frame member.

* * * * *